US005647480A

United States Patent [19]

Insley et al.

[11] Patent Number: 5,647,480

[45] Date of Patent: Jul. 15, 1997

[54] FLEXIBLE PRESSURE VESSELS FOR AND METHOD OF TRANSPORTING HAZARDOUS MATERIALS

[75] Inventors: Thomas I. Insley, Lake Elmo; Kay M. McCoy, Woodbury; Cynthia Y. Tamaki, Arden Hills, all of Minn.

[73] Assignee: Minnesota Mining and Manufacturing Company, St. Paul, Minn.

[21] Appl. No.: 378,814

[22] Filed: Jan. 27, 1995

[51] Int. Cl.[6] ..... B65D 81/02; B65D 81/26

[52] U.S. Cl. ..... 206/204; 206/521; 206/522; 383/3; 383/66

[58] Field of Search ..... 206/204, 205, 206/207, 210, 213.1, 521, 522, 807; 383/3, 66, 84

[56] References Cited

U.S. PATENT DOCUMENTS

| | | | |
|---|---|---|---|
| Re. 34,477 | 12/1993 | Cornwell | 383/71 |
| 3,188,266 | 6/1965 | Charbonneau et al. | 161/188 |
| 4,036,360 | 7/1977 | Deffeyes | 206/204 |
| 4,240,556 | 12/1980 | Field | 206/522 |
| 4,417,658 | 11/1983 | Gardner et al. | 383/66 |
| 4,434,893 | 3/1984 | Barlow | 383/3 |
| 4,509,196 | 4/1985 | Sak et al. | 383/66 |
| 4,679,688 | 7/1987 | Soderhold et al. | 206/204 |
| 4,861,632 | 8/1989 | Caggiano | 428/35.2 |
| 4,882,893 | 11/1989 | Spencer et al. | 53/449 |
| 4,927,010 | 5/1990 | Kannankeril | 206/204 |
| 4,969,750 | 11/1990 | Russo et al. | 383/113 |
| 5,150,971 | 9/1992 | Strong et al. | 383/84 |
| 5,199,795 | 4/1993 | Russo et al. | 383/113 |

FOREIGN PATENT DOCUMENTS

| | | | |
|---|---|---|---|
| 2652564 | 4/1991 | France | 383/66 |
| 1370803 | 10/1974 | United Kingdom | B65D 81/20 |
| 2177677 | 1/1987 | United Kingdom | 383/66 |
| WO85/01272 | 3/1985 | WIPO | B65D 81/02 |
| WO91/15406 | 10/1991 | WIPO | B65D 33/18 |
| 91/15406 | 10/1991 | WIPO | 383/66 |
| WO95/00417 | 1/1995 | WIPO | B65D 81/14 |

OTHER PUBLICATIONS

3M Scotchpak™ 241 Heat Sealable Polyester Film product information.

3M Scotch™ Joining Systems A–25 Acrylic Adhesive Family product information (Jan. 1989).

3M Scotch™ Silicone Adhesive Transfer Tape Y–9732 product information (Jun. 1986).

3M Scotch™ Joining Systems A–60 Acrylic Adhesive Family product information (Jan. 1990).

*Primary Examiner*—Jimmy G. Foster

*Attorney, Agent, or Firm*—Gary L. Griswold; Walter N. Kirn; Karl G. Hanson

[57] ABSTRACT

A flexible pressure vessel 20 having an aperture 44 through one wall 30 of the vessel 20, which aperture 44 can be closed by a closure flap 50 having sufficient surface area of adhesive 52 to completely surround the aperture 44. The adhesive 52 has sufficient peel strength to prevent the vessel 20 from being reused after closure, and the vessel 20 is capable of withstanding a pressure differential of at least 75 kPa for at least thirty minutes.

22 Claims, 3 Drawing Sheets

32
51

51
58
28
54
53
24
44
54
52
22
30
26

FLEXIBLE PRESSURE VESSELS FOR AND METHOD OF TRANSPORTING HAZARDOUS MATERIALS

TECHNICAL FIELD

The present invention pertains to (i) a liquid impervious flexible pressure vessel useful for transporting an article containing a hazardous material, and (ii) a method of using the flexible pressure vessel. The flexible pressure vessel is capable of withstanding, without liquid loss, a pressure differential with its ambient surroundings resulting from an internal pressure load. The method of vessel use includes placing a second container holding a potentially hazardous material within the flexible pressure vessel, adhesively sealing the flexible pressure vessel, and transporting the resultant package.

BACKGROUND OF THE INVENTION

Hazardous materials—including certain chemicals, poisons, and biologic elements—require safety controls in their packaging and handling for transport. Like other liquid hazardous materials, infectious substances transported by air or road are required to be contained in packaging that meets certified pressure performance. Pressure vessel performance is based on the packaging's ability to withstand, without visible liquid loss, a pressure differential resulting from an internal pressure load. General diagnostic specimens, which in the work place typically are treated as infectious substances, also are subject to regulatory influences.

Packaging suppliers for hazardous materials currently use rigid molded plastic containers as supplementary packaging to prevent harmful agents from entering the environment. Examples of the rigid containers are described in U.S. Pat. Nos. 5,160,021, 4,882,893, 4,872,563, 4,842,153 and 3,819,081. Known rigid containers generally are designed to hold several specimens and meet international transport pressure requirements. The rigid containers' dimensional tolerance limitations often necessitate using gaskets to sustain an internal pressure load, especially as the size of the container's opening increases in diameter and as a consequence of an increased pressure differential between the interior of the container and its ambient surroundings. Although the containers are well suited for transporting multiple samples, they may become economically unacceptable when samples are shipped in small numbers. The container's cost relative to the need to ship the sample may preclude its use. Further, when large quantities are shipped, the rigid containers also can be economically unacceptable because so many of the relatively expensive rigid vessels are needed. General diagnostic samples, for example, often are shipped in lots of over two hundred, making rigid walled pressure vessels sometimes prohibitively expensive to use. Further, the rigid containers' non-collapsible nature can pose problems from a storage and shipping standpoint because they create additional dead space, which consequently consumes more volume and leaves less room for additional samples. Also, the rigid containers typically are made of an opaque plastic, making it difficult to see the status of the shipped sample (e.g., sealed, broken, full, empty, et cetera).

Plastic bags also are used to transport and handle both infectious materials and general diagnostic samples. Traditionally, plastic bags are used to hold filled specimen containers. Although the plastic bags when sealed can isolate the contents from its surrounding environment, the bags suffer from the disadvantage of not being able to maintain an internal pressure load that is even minimally higher than the ambient surrounding pressure. Related shipping bags—see, for example, U.S. Pat. Nos. 5,199,795 and 4,927,010—are known to have closures that span their full width. The sealing mechanisms described in these patents, whether mechanical or adhesive, also are susceptible to failure when confronted with internal pressure loads applied to the containment vessel.

SUMMARY OF THE INVENTION

The flexible pressure vessel of this invention overcomes the limitations of known rigid pressure vessels and known plastic bags as supplemental packaging for hazardous materials such as chemical liquids, poisons, infectious agents and/or general diagnostic samples. The inventive vessels can be shipped and stored flat before use, and sealed after inserting a vial, small bottle, or test tube that contains the hazardous material. The inventive vessels also are able to withstand substantial internal pressure loads that often are encountered during air transport. In brief summary, the new flexible pressure vessel comprises (a) a flexible liquid impervious chamber having an interior; (b) an aperture for permitting insertion of an article into the chamber's interior; and (c) an aggressive adhesive for sealing the aperture and retaining the vessel in a closed condition for pressure differentials of 75 kPa or greater for thirty minutes. The term "flexible" means that the interior chamber is capable of readily responding or conforming when a slight pressure, namely, less than 5 kilopascals (kPa), is exerted thereon. The term "pressure differential" means the difference in pressure between the interior and exterior of the vessel.

The method of the invention comprises the steps of: (a) providing a first flexible pressure vessel that is liquid impervious and that has an internal containment portion accessible through an aperture that can be adhesively sealed closed using an aggressive adhesive that will allow the flexible pressure vessel to withstand a pressure differential of 75 kPa for thirty minutes without visual leakage; (b) placing at least one second container holding a sample of potentially hazardous material in the containment portion of the first flexible pressure vessel through the aperture; and (c) adhesively sealing the flexible pressure vessel's aperture in closed condition using the aggressive adhesive.

The invention provides a number of advantages for shipping hazardous materials. First, the flexible pressure vessel and method of the invention create economic efficiencies that can allow samples to be shipped in small numbers. Using relatively inexpensive materials such as plastic films or plastic-coated woven and nonwoven materials, and adhesives, while employing conventional manufacturing practices, cost effective pressure vessels of the present invention can be produced as supplemental packaging components. The article and method of the invention also provide storage and shipping benefits in that during storage they can be placed in an essentially flat configuration until being used and in that during shipment they consume less space for the same number of shipped samples. Further, sorbent material or cushioning foams may be placed in the vessel to provide an additional level of security, that may be achieved without significantly reducing the vessel's flexibility and its other advantages. An advantage of particular significance is that international transport requirements can be met by the article and method of the invention. The flexible pressure vessel is capable of withstanding an internal pressure load caused by the vessel's transport to an environment of lower pressure. When the vessel is transported by air, external pressure decreases as altitude increases and thus the pressure differential increases. The flexible pressure vessel can withstand the pressure differentials encountered during air transport and set forth by regulation. Additionally, the flexible vessel normally is transparent to enable the sample to be visually inspected for tracking or safety purposes. The inventive flexible pressure vessel therefore can enable indicia on the samples to be scanned by, for example, a bar-code reader. And after the flexible pressure vessel has served its purpose, only a minimum amount of packaging material requires disposal.

The above and other advantages of the invention are more fully shown and described in the drawings and detailed description of this invention, where like reference numerals are used to represent similar parts. It is to be understood, however, that the drawings and description are for the purposes of illustration only and should not be read in a manner that would unduly limit the scope of this invention.

DETAILED DESCRIPTION OF PREFERRED EMBODIMENTS

Figure 1:
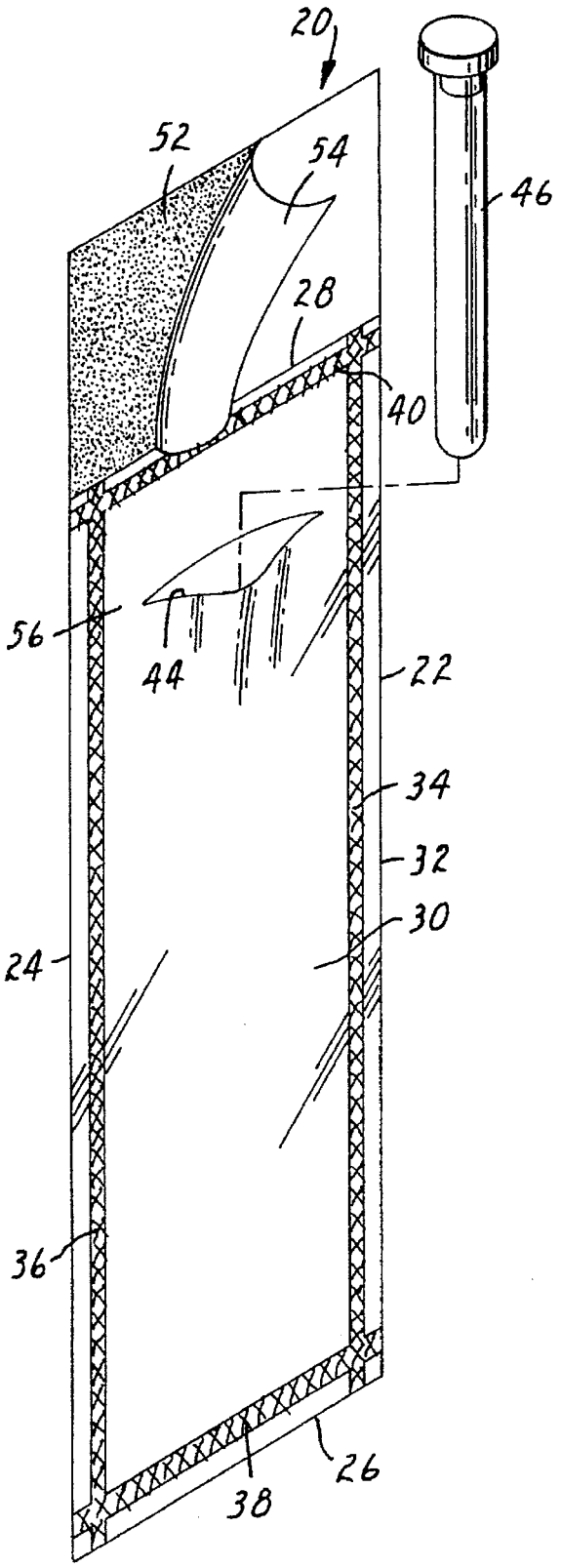
FIG. 1 is a perspective view of a first embodiment of the invention comprising a flexible pressure vessel 20 embodying the features of the present invention. The flexible pressure 20 is shown with the adhesive flap 50 in an open position for permitting a test tube 46 containing a potentially hazardous material to be inserted through the vessel's aperture 44.
Figure 2:
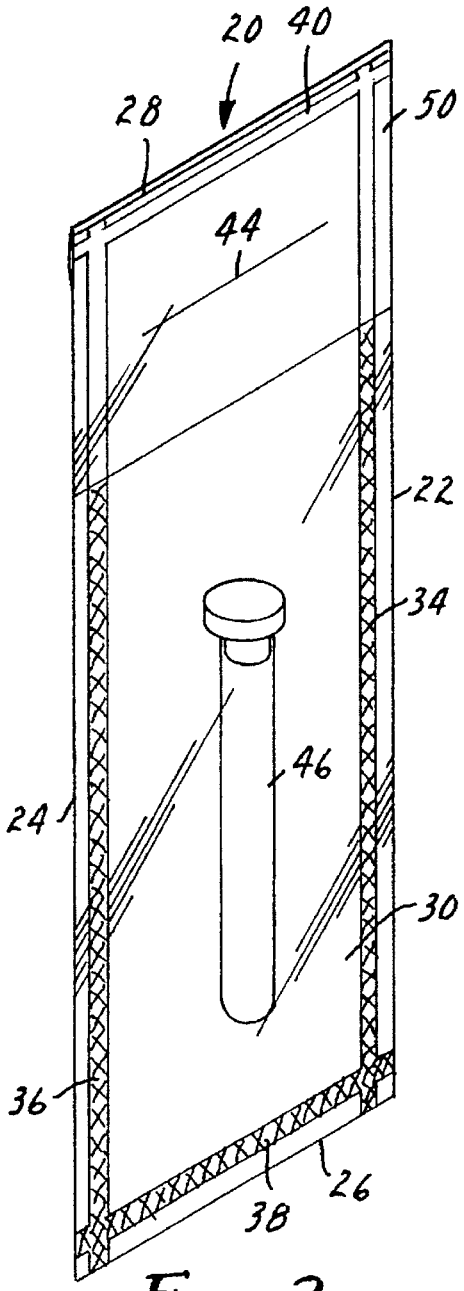
FIG. 2 is a perspective view of the first embodiment in a condition subsequent to that of FIG. 1, showing the adhesive flap 50 in its closed position sealed over the aperture 44 for isolating a test tube 46 contained within the vessel 20.

In the practice of the present invention, flexible materials can be configured into economical pressure vessels capable of withstanding extraordinary pressure differentials. FIGS. 1 and 2 illustrate a first preferred embodiment of a flexible pressure vessel (FPV) 20 incorporating features of the present invention. The FPV 20 projects a generally rectangular configuration in a flat condition and is closed at opposed side edges 22 and 24, the bottom edge 26, and the top edge 28. The vessel is provided with sufficient width so that a slit-shaped aperture 44 can be sealed in closed condition by an adhesively secured flap that, when closed, overlaps the aperture 44 with a sufficient adhesive area to withstand an internal pressure. The FPV preferably has a width in its flat condition of about 1 to 30 centimeters (cm), more preferably about 2 to 10 cm, and still more preferably about 3 to 6 cm. The vessel body is dimensioned to generally assume a cylindrical shape upon being subjected to internal pressures exceeding ambient pressure. The generally cylindrical shape assumed by the vessel body provides a generally uniform force distribution when the vessel's interior is under greater than ambient pressure. The cylindrical vessel may have essentially any length but typically is about 10 to 30 cm.

Opposing panels or walls 30 and 32 extend between edges 22, 24, 26 and 28, and form the boundaries of the containment portion of the FPV. Walls 30 and 32 are joined at side edges 22 and 24 by welds 34 and 36, respectively. Walls 30 and 32 are joined at top and bottom edges 28 and 26 by welds 40 and 38, respectively. Welds 34 and 36 extend substantially parallel to side edges 22 and 24, respectively, and in like manner welds 38 and 40 extend substantially parallel to bottom and top edges 26 and 28, respectively.

Figure 5:
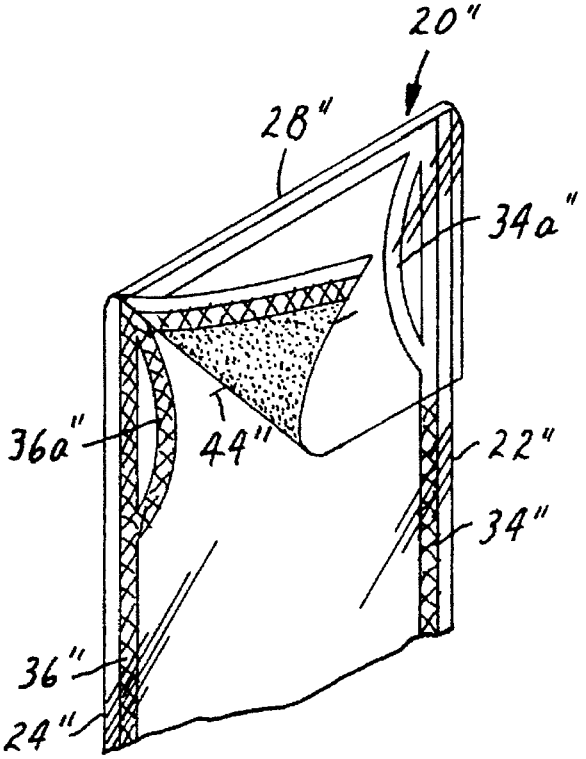
FIG. 5 is a partial perspective view of another embodiment of a vessel 20" wherein additional arcuate heat welds 34" are provided extending inwardly toward the periphery of the aperture from adjacent sides of the vessel in order to reduce the vessel's volume in the vicinity of the slit 44", and effectively reduce stress on the adhesive closure when an internal pressure is encountered.

To help relieve stress at the aperture, it is beneficial to reduce vessel diameter as much as possible. Thus, welds 34 and 36 can be provided with arcuate necking portions **34*a*" and 36*a*" as shown in FIG. 5. Necking welds 34*a*" and 36*a*" extend inwardly from side edges 22" and 24", respectively, adjacent top edge 28". The provision of necking welds 34*a*" and 36*a*"** reduces the diameter of the cylindrical shape in the area of the aperture to limit the stress imposed on the FPV as a result of internal pressure in the area of the necking welds.

Walls 30 and 32 may be constructed of a plastic film that provides high strength and superior barrier properties. The plastic film from which the FPV may be constructed, preferably has a tensile strength of at least 20 Newtons per centimeter (N/cm). More preferably, the plastic film has a tensile strength of at least 40 N/cm. Tensile strength can be determined in accordance with ASTM D882-88, Method A. Walls 30 and 32 may be fused or welded by heat or chemical or mechanical means. The welds may be formed using for example, a hot platen press or an ultrasonic welding device. An example of a suitable heat-weldable plastic film includes Scotchpack™ 241, Minnesota Mining and Manufacturing Company (3M), St. Paul, Minn. Portions or whole panels of the walls may be reinforced using additional layers of material. Juxtaposed layers may be held together by, for example, adhesives. The vessels walls thus may be constructed from multi-layered plastic films.

U.S. Pat. No. 3,188,266 describes a multi-layer plastic film that can be used in the FPV of the invention. Briefly, this plastic layer comprises a thin, strong, tough, heat-resistant oriented polyester film coated with a thin, heat-sealable layer of polyethylene to form a total film thickness of about 25 to 250 microns, with the polyester and polyethylene layers of the film being bonded together at the interface such that the film could not be manually pulled apart under normal conditions of temperature and humidity. The disclosure of this patent is incorporated here by reference.

As a containment for bottles, vials, test tubes, or specimen chambers, the aperture 44 of the flexible pressure vessel 20 can be configured to minimize the pressure bearing surface area—allowing for an adhesive seal of the aperture 44 that is effective in containing internal pressures. Aperture 44 is shaped to allow for the insertion of a second container into the containment portion of the FPV, while minimizing the area that must be sealed closed against internal pressures generated within the containment portion of the FPV. As shown, a slit-shaped aperture 44 may be provided in wall 30. The aperture preferably is in the form of a slit having a length of about 0.5 to 20 cm, and more preferably of about 1 to 6 cm. Slit-shaped aperture 44 is substantially parallel to top edge 28 and is spaced from heat welds 40, 34 and 36 by a distance sufficient to leave a surrounding smooth target area having a size adequate for adhesive sealing by flap 50. The slit is located on one wall of the vessel's chamber spaced at least 0.5 cm from the side edges, more typically spaced at least 1 cm.

The second article may have a label located thereon to identify its contents. The label may be, for example, a bar-coded symbol on a sheeting such as a retroreflective sheeting. A retroreflective sheeting is one that is capable of returning a substantial portion of incident light in the direction from which the light originated.

Flap 50 can be integral to the vessel (that is, formed as a single part therewith) or separate from the vessel and is positioned to contact target area 56 around the perimeter's aperture. Flap 50 has a width substantially equal to the FPV's width and a length sufficient to extend downwardly from top edge 28 along wall 30 over slit-shaped aperture 44. Flap 50 can be provided as an extension of either one or both walls 30 and 32. Adhesive 52 preferably is provided over the entire surface area of flap 50 and can be furnished as a layer covered by a protective backing strip 54, to be removed by the user before folding flap 50 down from top edge 28 to seal aperture 44. The contact of the adhesive 52 to area 56 around the aperture's perimeter provides a barrier to fluid leakage, as well as allowing the flexible pressure vessel's aperture 44 to withstand the required internal pressure load. Target area 56 preferably is provided as a smooth, relatively featureless surface. Wall 30 is provided with a sufficiently large target area 56 surrounding slit-shaped aperture 44 so that when flap 50 and adhesive 52 are brought into contact with target area 56, thereby sealing closed slit-shaped aperture 44, the FPV withstands a pressure differential of 75 kPa for thirty minutes without fluid leakage.

The adhesive provided on the flap is an "aggressive adhesive"; that is, it is an adhesive having a strength that is sufficiently high to preclude the possibility of reusing the flexible pressure vessel after opening. The area occupied by the adhesive on the vessel typically is about 1 to 100 square centimeters ($cm^2$), more typically about 5 to 50 $cm^2$. An attempt to break the adhesive bond would destroy the vessel's chamber or not permit the vessel to be resealed to withstand a pressure differential of 75 kP or greater. Once the flexible pressure vessel is sealed, it preferably behaves as if there is no closure at all, and any failure of the bag as a result of internal pressure loads generally occurs in the material of the bag rather than at the sealed closure. Thus, the adhesive preferably forms a bond that is at least as strong as the vessel itself. The ability of the FPV to withstand a pressure differential of 75 kPa for thirty minutes is a result of a combination of factors, including strength of adhesive, aperture area, strength of flexible plastic, geometry of pressure vessel, and weld strength. Preferably, the FPV of the invention can withstand pressure differential of 95 kPa for thirty minutes. The FPV's ability to withstand pressure differentials is determined by testing the FPV in accordance with standardized test ASTM D 4919-89, using test method A2, the Hydrostatic Test.

The aggressive adhesive 52 provided on flap 50 can be selected from a group of acrylic pressure-sensitive adhesives manufactured by 3M, including a 50 micron thick Adhesive Transfer Tape—types 3M 922XL or 3M 927. Alternatively, silicone adhesives, such as CW-14-736 available from Specialty Tapes, Racine, Wis. can be used to seal flap 50 over aperture 44. The adhesive 52 is selected to preferably have a peel energy per unit aperture length of at least 0.02 Joules per centimeter (J/cm), more preferably at least 0.2 J/cm, and even more preferably at least 0.3 J/cm, when the adhesive is evenly distributed around the aperture.

Peel energy per unit area of adhesive can be determined by the procedures described in ASTM D 1876-72, Standard Test Method for Peel Resistance of Adhesives (T-Peel Test). In using ASTM D1876-72 to determine peel energy per unit length of aperture, the following parameters should be specified: (i) cross-head speed not exceeding 0.5 millimeters per minute (mm/min); (ii) samples adhered for not more than 30 minutes before testing; and (iii) peel energy determined for a peel distance between 5 and 65 mm (the length of the bond is half the peel distance). As the term is used in here, "ASTM D 1876-72" means ASTM D 1876-72 where the test is carried out using the parameters set forth in the previous sentence.

When the aperture takes the form of something other than a slit, for example, a circular opening, the adhesive preferably is selected to have a peel energy per unit area of aperture of at least 0.02, more preferably at least 0.20, and even more preferably at least 0.30 $J/cm^2$. Peel energy per unit area of aperture also may be determined using ASTM D 1876-72. Testing for determining peel energy may be conducted on an Instron Tensile tester model number 4302.

Figure 3:
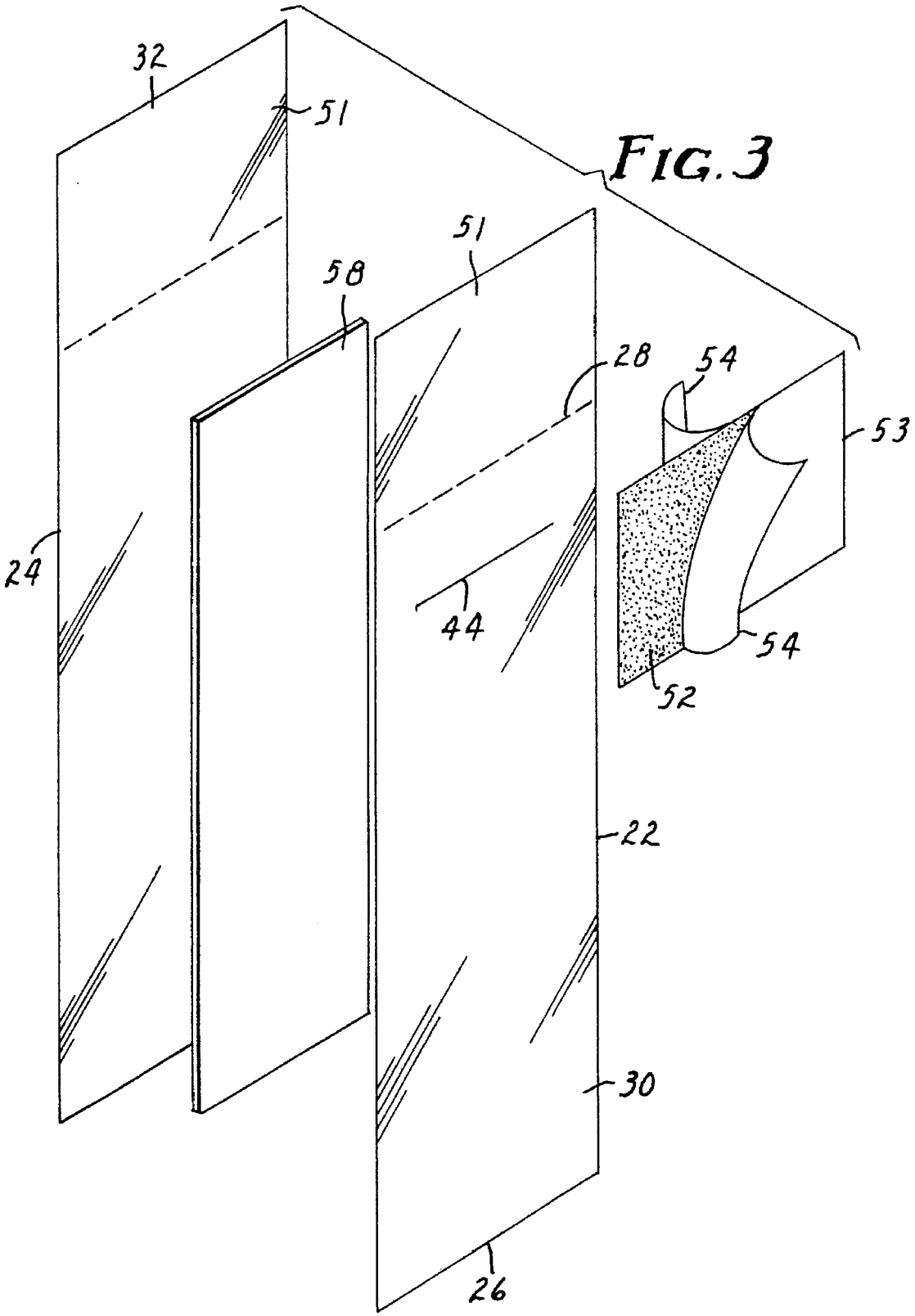
FIG. 3 is an enlarged exploded perspective view of the first embodiment of the vessel 20 of FIG. 1, wherein the body of the vessel is constructed from two separate layers of material.

In FIG. 3, the FPV is shown constructed from two separate sheets of material that form front and back walls 30 and 32, respectively. Walls 30 and 32 are welded (for example heat sealed) along side, bottom and top edges, with or without a sorbent material 58 contained therebetween, and with one or both of walls 30 and 32 extending beyond top edge 28 in order to form a non-adhesive flap 51. Adhesive 52 is provided on two-sided adhesive strip 53 and is applied to non-adhesive flap 51 after one side of protective backing 54 is removed from strip 53. The other side of strip 53 remains covered by protective backing 54 until the user is ready to fold flap 51 with attached adhesive strip 53 down from top edge 28 in order to seal closed aperture 44.

Adhesive strip 53 can be bonded to non-adhesive flap 51 by removing one side of its protective backing and then applying the strip to non-adhesive flap 51. Closure of the FPV is achieved by removing the other side of protective backing from strip 53 so that the adhesive is exposed, thereby permitting application of flap 51 over the slit type aperture 44.

Figure 4:
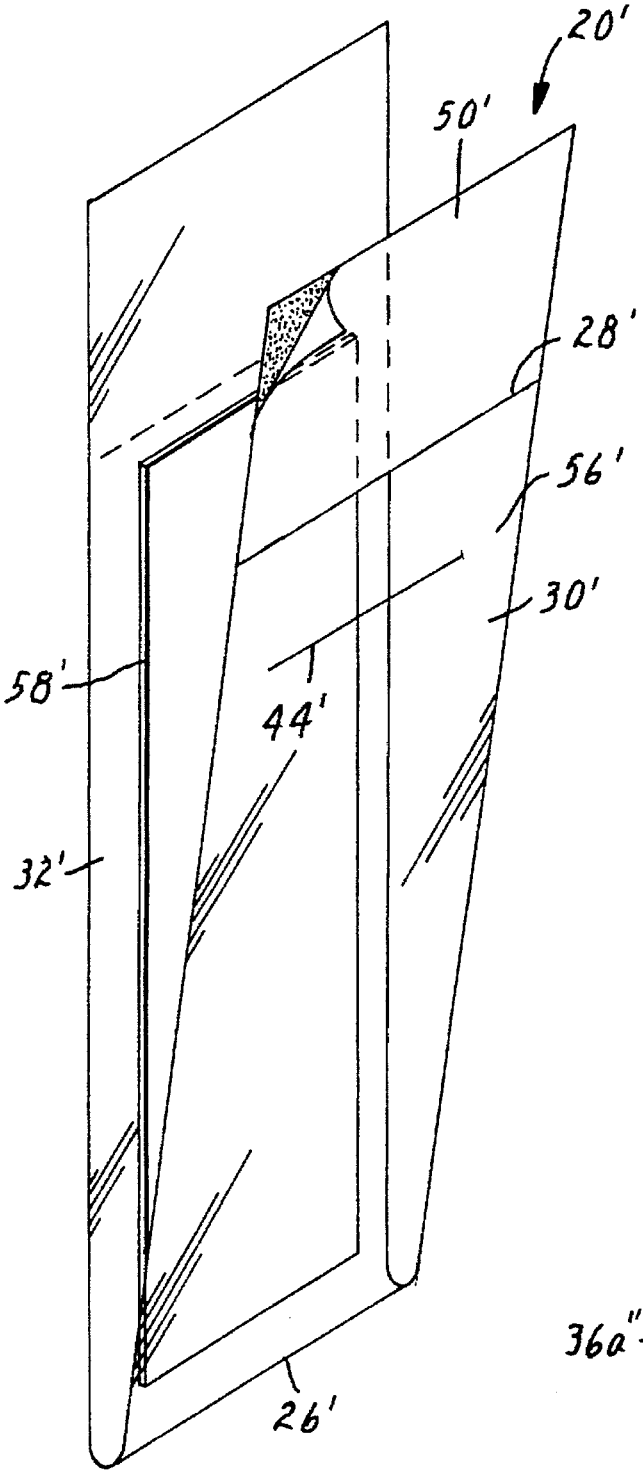
FIG. 4 is an enlarged fragmentary perspective view of a second embodiment of a vessel 20' similar to that of FIG. 1, but wherein the body of the vessel is constructed from a single layer of material that is folded over to define one end 26.

The FPV 20', as shown in FIG. 4, can be constructed from a single layer of material that is folded over and then heat sealed along the side and top edges. Before the vessel is sealed, a narrow, slit-shaped aperture 44' is provided through front wall 30' at a sufficient distance from top edge 28' to leave the desired target area 56' surrounding aperture 44'. A sorbent material 58' also can be provided within the FPV in order to provide liquid sorbent means in case test tube 46 is broken while being transported in the FPV.

The sorbent material also may serve as cushioning means to dampen shock. Cushioning materials are particularly useful when a fragile article, for example, a glass container, is shipped in the FPV. The sorbent/cushioning material may be, for example, a nonwoven web of melt blown microfibers, which also contains microfiber microwebs, such as described in U.S. Pat. No. 4,813,948 to Insley, incorporated herein by reference.

The sorbent material also may include other ingredients in addition to the sorbent medium. For instance, a nonwoven web of melt blown microfibers may be loaded with discrete solid particles capable of interacting with (for example, chemically or physically reacting with) a fluid to which the particles are exposed. Such particles can remove a component from a fluid by sorption, chemical reaction, or amalgamation or a catalyst may be employed to convert a hazardous fluid to a harmless fluid. An example of a particle-loaded nonwoven web of microfiber is disclosed in U.S. Pat. No. 3,971,373 to Braun, where discreet solid particles of activated carbon, alumina, sodium bicarbonate, and/or silver are uniformly dispersed throughout and are physically held in the web to absorb a fluid; see also, U.S. Pat. No. 4,100,324 to Anderson et al. and U.S. Pat. No. 4,429,001 to Kolpin et al.

Also, additives such as dyes, pigments, fillers, surfactants, abrasive particles, light stabilizers, fire retardants, absorbents, medicaments, disinfectants, gelling agents, et cetera, also may be added to the web by introducing such components to the fiber-forming molten polymers or by spraying them onto the fibers after the web has been collected.

A method of using the FPV described above for the transport of potentially hazardous materials, including diagnostic samples, can comprise the following steps:

a) providing a first flexible pressure vessel constructed from heat sealable plastic film having high strength and being liquid impervious, the flexible pressure vessel having an internal containment portion accessible through an aperture that can be adhesively sealed closed using an aggressive adhesive, allowing the FPV to withstand a pressure differential in the containment portion of 75 kPa for thirty minutes without any leakage;

b) placing a second container holding samples of potentially hazardous material in the containment portion of the first flexible pressure vessel through the aperture; and c) adhesively sealing the aperture of the flexible pressure vessel in closed condition.

A multitude (for example, greater than 10) sealed FPVs containing hazardous materials may be packaged in a third article or final shipping container such as a crate, cardboard box, plastic cooler, et cetera. The packaged FPVs may be transported to a distant location. FPVs of this invention are particularly useful for air transport because they can withstand great pressure differentials, which occur as altitude increases.

Hazardous materials that may be shipped using FPVs of this invention include liquid chemicals, poisons, bacteria, fungi, viruses, rickettsiac, chlamydiae, parasites, recombinant products, allergens, cultured animal cells and the potentially infectious agents these cells may contain, infected clinical specimens (tissues, fluids, et cetera), tissues from experimental animals, plant viruses, bacteria, fungi, and toxins. In addition to hazardous materials valuable or nuisance materials may be shipped using FPVs when protection against liquid loss, tamper evidence, or fluid retention is an important factor during handling.

There are numerous possible variations in package structure and composition that can be used to practice the method of the present invention. It is intended that the scope of the present invention not be limited to the specific materials and examples presented herein, but that those variations and modifications that come within the true spirit and scope of the present invention, as presented in the appended claims, be included.

What is claimed is:

1. A flexible pressure vessel that comprises:

(a) a flexible liquid impervious chamber having an interior and being formed from a material having a tensile strength of at least 20 Newtons per centimeter;

(b) an aperture located in the chamber for permitting an article to be inserted into the chamber's interior; and (c) an aggressive pressure sensitive adhesive disposed on the vessel at a location for sealing the aperture, the adhesive being adapted to close the flexible pressure vessel such that the resultant seal withstands a pressure differential of 75 kilopascals or greater for thirty minutes.

2. The flexible pressure vessel of claim 1, wherein the flexible liquid impervious chamber is constructed from a transparent plastic film that allows an observer to inspect the status of an article located in the interior chamber.

3. The flexible pressure vessel of claim 1, wherein the chamber is formed by welding the plastic film along side edges to define a periphery of the chamber, and wherein a portion of the weldable plastic film forms a flap on which the aggressive adhesive is disposed.

4. The flexible pressure vessel of claim 1, wherein the aperture is a slit that extends across the plastic film spaced at least 0.5 centimeters from the chamber's periphery.

5. The flexible pressure vessel of claim 1, further including a sorbent material contained within the interior chamber.

6. The flexible pressure vessel of claim 1, wherein the vessel is cylindrical in shape and has a width of 3 to 6 centimeters.

7. The flexible pressure vessel of claim 6, wherein the vessel includes necking welds that reduce a diameter of the cylindrical vessel in the area of the aperture.

8. The flexible pressure vessel of claim 1, wherein the aggressive adhesive is an acrylic pressure sensitive adhesive or a silicone adhesive.

9. The flexible pressure vessel of claim 1, wherein the aperture is in the form of a slit.

10. The flexible pressure vessel of claim 1, wherein the adhesive provides a peel energy per unit length of aperture of at least 0.02 Joules per centimeter.

11. The flexible pressure vessel of claim 10, wherein the adhesive provides a peel energy per unit length of aperture of at least 0.2 Joules per centimeter.

12. The flexible pressure vessel of claim 1, wherein the adhesive provides a peel energy per unit area of aperture of at least 0.2 Joules per centimeter.

13. The flexible pressure vessel of claim 1, wherein the adhesive occupies an area of 1 to 100 square centimeters on the vessel.

14. The flexible pressure vessel of claim 1, wherein the flexible liquid impervious chamber is constructed from a transparent plastic film.

15. The flexible pressure vessel of claim 1, wherein the flexible liquid impervious chamber is constructed from a transparent plastic film having a tensile strength of at least 40 Newtons per centimeter.

16. The flexible pressure vessel of claim 1, further comprising a closure member that in conjunction with the aggressive adhesive, seal the liquid impervious chamber at the aperture.

17. The flexible pressure vessel of claim 16, wherein the aggressive adhesive is disposed on the closure member.

18. A second container that includes a plurality of sealed flexible pressure vessels of claim 1, the plurality of sealed flexible pressure vessels being disposed in the second container.

19. A flexible pressure vessel capable of maintaining a pressure differential substantially in excess of atmospheric pressure for use in transporting a container of potentially hazardous material comprising:

a front panel and a back panel, each having opposite side edges, a top edge and a bottom edge, and being connected along the opposite side edges, the top edges and the bottom edges, the panels being formed from a polymeric material(s) that has a tensile strength of at least 20 Newtons per centimeter;

an aperture having two ends and extending through said front panel, said aperture being of a shape and size which permits insertion of a container through the aperture, the aperture being spaced inwardly from the side edges;

a closure member overlapping the aperture when the vessel is closed with portions of the closure member extending above and below the aperture and extending beyond the ends of the aperture; and a pressure sensitive adhesive disposed on the vessel at a location for sealing the closure member over the aperture, the adhesive forming a bond such that the aperture when closed and the vessel both being able to withstand without significant fluid loss a pressure differential of 75 kilopascals or greater for thirty minutes.

20. The flexible pressure vessel of claim 19, wherein said front and back panels are constructed from heat weldable plastic film that is liquid impervious and said front and back panels are connected by heat welding.

21. The flexible pressure vessel of claim 19, wherein the aperture is slit-shaped and has a length of 0.5 to 20 centimeters.

22. A second container that includes a plurality of sealed flexible pressure vessels of claim 19, the plurality of sealed flexible pressure vessels being disposed in the second container.

* * * * *